US008622723B2

(12) United States Patent
Matsukawa et al.

(10) Patent No.: US 8,622,723 B2
(45) Date of Patent: Jan. 7, 2014

(54) SCROLL COMPRESSOR

(75) Inventors: Kazuhiko Matsukawa, Sakai (JP); Hiroyuki Yamaji, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1029 days.

(21) Appl. No.: 12/669,240

(22) PCT Filed: Jul. 23, 2008

(86) PCT No.: PCT/JP2008/063146
§ 371 (c)(1),
(2), (4) Date: Jan. 15, 2010

(87) PCT Pub. No.: WO2009/014128
PCT Pub. Date: Jan. 29, 2009

(65) Prior Publication Data

US 2010/0189585 A1 Jul. 29, 2010

(30) Foreign Application Priority Data

Jul. 25, 2007 (JP) ..... 2007-193277

(51) Int. Cl.
*F01C 1/02* (2006.01)
*F01C 1/063* (2006.01)
*F03C 2/00* (2006.01)

(52) U.S. Cl.
USPC ..... 418/55.1; 418/55.2; 418/55.5

(58) Field of Classification Search
USPC ..... 418/55.1, 55.2, 55.5
See application file for complete search history.

(56) References Cited

U.S. PATENT DOCUMENTS 6,138,923 A * 10/2000 Nakano et al. ..... 239/88
6,146,119 A * 11/2000 Bush et al. ..... 418/55.4
6,589,035 B1 * 7/2003 Tsubono et al. ..... 418/55.5
7,331,774 B2 * 2/2008 Ueda et al. ..... 418/55.5

FOREIGN PATENT DOCUMENTS

JP 57-43369 U 8/1980
JP 3-61681 A 3/1991
JP 03-189382 A 8/1991
JP 08-270557 A 10/1996
JP 10-37857 A 2/1998
JP 2001-349449 A 12/2001
JP 2007-154761 A 6/2007
JP 2007-154762 A 6/2007

OTHER PUBLICATIONS

Chinese Office Action of corresponding Chinese Application No. 200880100335.3 dated Apr. 25, 2011.

* cited by examiner

*Primary Examiner* — Thomas Denion
*Assistant Examiner* — Anthony Ayala Delgado
(74) *Attorney, Agent, or Firm* — Global IP Counselors

(57) ABSTRACT

A scroll compressor includes first and second scroll members housed in a casing. The first scroll member has a fluid inlet and a first through hole spaced from the fluid inlet. A fluid introducing pipe is configured to connect to the first through hole. A piston, having an annular groove and a second through hole, is disposed in the first through hole and is biased toward the fluid introducing pipe. The piston is configured to shut an end of the first through hole when fluid pressure larger than the biasing force is introduced into the fluid introducing pipe and to open the end of the first through hole when fluid pressure smaller than the biasing force is introduced into the fluid introducing pipe. A piston ring is fitted into the annular groove of the piston and has a stepped fitting end.

1 Claim, 11 Drawing Sheets

SCROLL COMPRESSOR

CROSS-REFERENCE TO RELATED APPLICATIONS

This U.S. National stage application claims priority under 35 U.S.C. §119(a) to Japanese Patent Application No. 2007-193277, filed in Japan on Jul. 25, 2007, the entire contents of which are hereby incorporated herein by reference.

TECHNICAL FIELD

The present invention relates to a scroll compressor, and particularly to a scroll compressor capable of regulating its suction capacity.

BACKGROUND ART

In the past, a technique has been introduced for providing a scroll compressor in which a suction capacity regulating mechanism is installed in an end plate of a fixed scroll (see Japanese Laid-open Patent Application No. 2007-154761, for example).

This suction capacity regulating mechanism is primarily composed of a through hole which penetrates through the end plate of the fixed scroll and opens at the bottom of a spiral groove of the fixed scroll, a fluid introducing passage which connects to the through hole, a piston which is inserted into the through hole, a biasing member which biases the piston toward a side of the fluid introducing passage in the through hole, and a metal piston ring which is fitted into an annular groove of the piston and which has a right-angled fitting end. The suction capacity regulating mechanism regulates a suction capacity of a scroll compressing mechanism by switching between a regulating operation condition involving a connection between "a first compression chamber formed between an inner circumferential surface of a wrap of the fixed scroll and an outer circumferential surface of a wrap of a movable scroll" and "a second compression chamber formed between an outer circumferential surface of the wrap of the fixed scroll and an inner circumferential surface of the wrap of the movable scroll" and a normal operation condition of shut-off between the first compression chamber and the second compression chamber (a condition that utilizes 100% of the suction capacity). Specifically, when a fluid that applies a pressure larger than biasing force of the biasing member per unit area is introduced into the fluid introducing passage, the piston is pushed down and a space at a lower end of the through hole is shut. The suction capacity regulating mechanism is turned to a condition of shut-off between the first compression chamber and the second compression chamber, that is, a normal operation condition. On the other hand, when a fluid that applies a pressure lower than biasing force of the biasing member per unit area is introduced into the fluid introducing passage, the piston is pushed up and the space at the lower end of the through hole is open. The suction capacity regulating mechanism is turned to a condition involving a connection between the first compression chamber and the second compression chamber, that is, a regulating operation condition.

SUMMARY

Technical Problem

In the above suction capacity regulating mechanism, a minute gap exists between the through hole and the piston.

Therefore, when a high-pressure fluid is introduced into the fluid introducing passage, the high-pressure fluid may undesirably flow into the compression chamber through the gap and the power of the scroll compressor under the normal operation may be reduced. In order to address this problem, in this suction capacity regulating mechanism, the metal piston ring which has a right-angled fitting end is fitted into the annular groove of the piston. This piston ring is tightly in contact with a wall surface of the through hole due to its resilient force so as to prevent the high-pressure fluid introduced into the fluid introducing passage from flowing into the compression chamber. However, in the metal piston ring having a right-angled fitting end, in a state that the piston ring is inserted into the through hole along with the piston, a slight gap exists at a part of the fitting end. Therefore, the above structure cannot perfectly prevent the high-pressure fluid introduced into the fluid introducing passage from flowing into the compression chamber.

An object of the present invention is to further suppress the flow of high-pressure fluid from the fluid introducing passage into a compression chamber and to suppress a power reduction of the scroll compressor under a normal operation, in a scroll compressor in which a suction capacity regulating mechanism is installed in an end plate of a fixed scroll.

Solution to Problem

A scroll compressor according to a first aspect of the present invention comprises a first scroll member, a second scroll member, a casing, a fluid introducing pipe, a piston, and a piston ring having a step-like fitting end. The first scroll member has a first flat plate part, a first spiral wall part, a fluid inlet, and a first through hole. The first spiral wall part extends from a first plate surface of the first flat plate part toward a direction substantially perpendicular to the first plate surface while keeping a spiral shape. The fluid inlet is formed near an end of the first spiral wall part. Note that this fluid inlet may be provided in the first flat plate part. The first through hole is formed in the first plate surface and extends so as to penetrate through the first flat plate part from a first opening which opens at a part of the first plate surface located at a position apart from the fluid inlet for a predetermined length. The first through hole is sandwiched between a most outer wall of the first spiral wall part and an inner circumferential wall which is opposite to the most outer wall. The second scroll member has a second flat plate part and a second spiral wall part. The second spiral wall part extends from a second plate surface of the second flat plate part toward a direction substantially perpendicular to the second plate surface while keeping a spiral shape. And, the second spiral wall part meshes with the first spiral wall part. The casing houses the first scroll member and the second scroll member. The fluid introducing pipe penetrates and extends through the casing from an opening formed at a side opposite to the first opening of the first through hole. And, an inner space of the fluid introducing pipe connects to the first through hole. The piston has an annular groove and a second through hole. The annular groove is formed on a side surface of the piston. The second through hole opens on an end surface of the piston at a side of the fluid introducing pipe and a bottom surface of the annular groove. Note that in the second through hole, the number or arrangement of openings which open at an end surface of the piston on the side of the fluid introducing pipe, as well as the number or arrangement of openings which open at the bottom surface of the annular groove, can be appropriately determined. Moreover, a cross-sectional area of the second through hole is preferably larger than a cross-sectional area of a gap between the piston and the first through hole. And, this piston is biased to a side of the fluid introducing pipe in the first through hole by a biasing member. This piston is configured so that the piston shuts the first opening when a fluid that applies a pressure larger than biasing force of the biasing member per unit area is introduced into the fluid introducing pipe and so that the piston forms a gap space on an upper part of the first opening when a fluid that applies a pressure smaller than the biasing force of the biasing member per unit area is introduced into the fluid introducing pipe. The piston ring having the step-like fitting end is fitted into the annular groove of the piston.

In this scroll compressor, the annular groove and the second through hole are formed in the piston, and further, the piston ring having the step-like fitting end is fitted into the annular groove. Therefore, in this scroll compressor, when a fluid that applies a pressure larger than biasing force of the biasing member per unit area is introduced into the fluid introducing pipe and the first opening is shut by the piston, the high-pressure fluid passes through the second through hole of the piston and pushes the piston ring having the step-like fitting end against a wall of the second through hole. Note that the piston ring expands slightly at this time; however, since the fitting end has a step-like structure, a gap is not formed in the piston ring and it is able to avoid a leak of the high-pressure fluid effectively. Further, at this time, the high-pressure fluid flows through a minute gap between the piston and the second through hole. Thus, the piston ring is pushed against a side of the first opening. Therefore, in this scroll compressor, when a fluid that applies a pressure larger than biasing force of the biasing member per unit area is introduced into the fluid introducing pipe, it is able to effectively suppress the high-pressure fluid flowing into compression chambers formed by the first scroll member and the second scroll member. Therefore, in this scroll compressor, it is able to suppress a power reduction of the scroll compressor under a normal operation (at the time of an operation utilizing 100% of the suction capacity).

A scroll compressor according to a second aspect of the present invention is the scroll compressor according to the first aspect of the present invention, wherein the first scroll member further has a third through hole which connects to the first through hole. Furthermore, the third through hole causes the first through hole to connect to a low-pressure space of the scroll compressor. And the piston shuts the first opening as well as an opening of a side of the piston in the third through hole when a fluid that applies a pressure larger than biasing force of the biasing member per unit area is introduced into the fluid introducing pipe. And, the piston connects the gap space and the third through hole when a fluid that applies a pressure smaller than the biasing force of the biasing member per unit area is introduced into the fluid introducing pipe.

Advantageous Effects Of Invention

The scroll compressor according to the present invention, when a fluid that applies a pressure larger than biasing force of the biasing member per unit area is introduced into the fluid introducing pipe, is able to effectively suppress the flow of the high-pressure fluid into the compression chamber formed by the first scroll member and the second scroll member. Therefore, in this scroll compressor, a power reduction of the scroll compressor under a normal operation (at the time of an operation utilizing 100% of the suction capacity) can be suppressed.

DETAILED DESCRIPTION OF THE EMBODIMENTS

The First Embodiment

Figure 1:
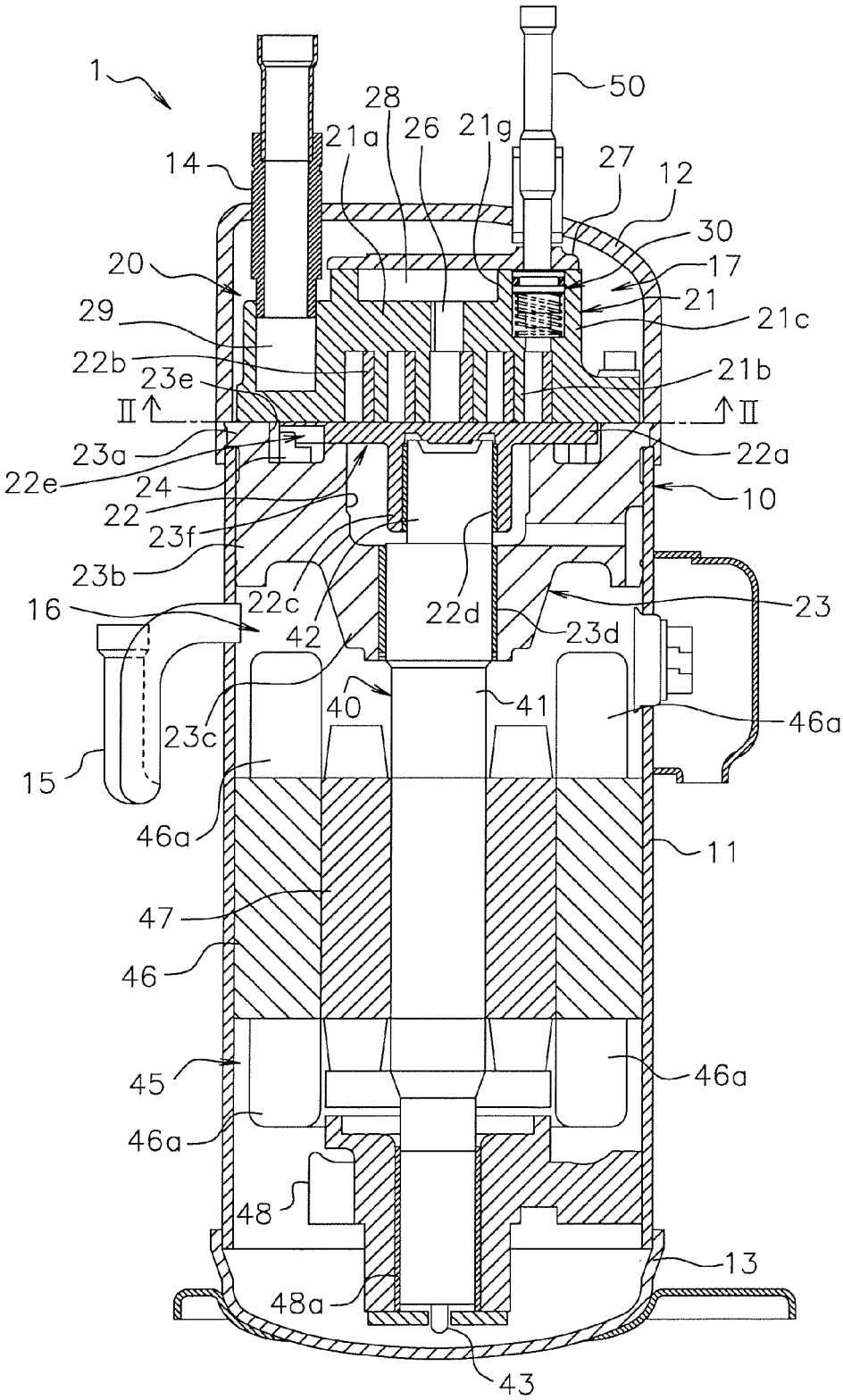
FIG. 1 is a longitudinal sectional view of a scroll compressor according to the first embodiment.

The high pressure dome-type scroll compressor 1 according to the first embodiment can be used together with an evaporator, a condenser, an expansion mechanism, and the like to constitute a refrigerant circuit. The high pressure dome-type scroll compressor 1 takes on a role of compressing a low pressure gas refrigerant in the refrigerant circuit so as to produce a high pressure gas refrigerant, and is primarily composed of a hermetically sealed dome-type casing 10, a scroll compression mechanism 20, a suction capacity regulating mechanism 30, a drive motor 45, a crank shaft 40, a lower main bearing 48, a suction tube 14, and a discharge tube 15, as shown in FIG. 1. The constituent elements of the high pressure dome-type scroll compressor 1 will be respectively described in detail below.

<Details of Constituent Elements of High Pressure Dome-Type Scroll Compressor>

(1) Casing

The casing 10 includes a substantially cylindrical trunk shell 11, a bowl-shaped lid portion 12 which covers an upper end of the trunk shell 11, and a bowl-shaped bottom portion 13 which covers a lower end of the trunk shell 11. Furthermore, the trunk shell 11 and the lid portion 12, as well as the trunk shell 11 and the bottom portion 13, are welded in an airtight manner and thereby integrated so as to prevent a gas refrigerant from leaking. And, primarily accommodated in the casing 10 are the scroll compression mechanism 20 for compressing a gas refrigerant, and the drive motor 45 disposed below the scroll compression mechanism 20. Furthermore, the scroll compression mechanism 20 and the drive motor 45 are connected by the crank shaft 40 disposed so as to extend in the vertical direction inside the casing 10.

(2) Scroll Compression Mechanism

The scroll compression mechanism 20 is primarily composed of a housing 23, a fixed scroll 21 provided in close contact above the housing 23, a movable scroll 22 for meshing with the fixed scroll 21, and an Oldham ring 24 for preventing the movable scroll 22 from rotating as shown in FIG. 1. The constituent elements of this scroll compression mechanism 20 will be respectively described in detail below.

a) Housing

The housing 23 is constructed primarily with a flange part 23*a*, a main body part 23*b*, and a bearing part 23*c*. The main body part 23*b* is designed to fit into the trunk shell 11 of the casing 10 and to couple with it. The flange part 23*a* protrudes radially outward from the main body part 23*b* at an upper end of the main body part 23*b*. The bearing part 23*c* is formed so as to have a smaller diameter than that of the main body part 23*b* and protrudes downward from a lower surface of the main body part 23*b*. This bearing part 23*c* rotatably supports a main shaft part 41 of the crank shaft 40 via a slide bearing 23*d*.

b) Fixed Scroll

The fixed scroll 21 is, as shown in FIG. 1, constructed primarily with an end plate 21*a* formed in a substantially disk-shape, a spiral (an involute-shaped) wrap 21*b* which is formed on a lower surface of the end plate 21*a*, and an edge portion 21*c*.

A discharge passage 26 that is in connection with a compression chamber formed by the fixed scroll 21 and the movable scroll 22, an enlarged concave portion 21 g that is in connection with the discharge passage 26, and a communication hole 32 which is needed to constitute the suction capacity regulating mechanism 30 are formed in the end plate 21*a*. The discharge passage 26 is formed so as to extend in the vertical direction in a center portion of the end plate 21*a*. The enlarged concave portion 21*g* is formed from a concavity that is open on an upper surface of the end plate 21*a*. A lid body 27 is fastened and fixed on an upper surface of the fixed scroll 21 by a bolt (not shown) so as to close the opening of the enlarged concave portion 21*g*. The lid body 27 covers the enlarged concave portion 21*g*, thereby forming a discharge space 28. Furthermore, the end plate 21*a* and the lid body 27 are sealed together by being firmly joined together via a packing which is not shown. Furthermore, a gas refrigerant discharged to the above-mentioned discharge space 28 is introduced into a high-pressure space 16 in a lower portion of the housing 23 through a gas passage (not shown) formed on the fixed scroll 21 and the housing 23, and is then discharged from the discharge tube 15 to the outside of the casing 10. Further, in the casing 10, a space in a lower portion of the housing 23 corresponds to the high-pressure space 16, and a space in an upper portion of the housing (a space around the compressing mechanism 20) corresponds to a low-pressure space 17. The communicating hole 32 is a hole which penetrates through the end plate 21*a* along a direction of thickness of the end plate 21*a*, and comprises a large diameter hole portion 32*a* and a small diameter hole portion 32*b*. The large diameter hole portion 32*a* opens at an upper surface of the end plate 21*a*. The small diameter hole portion 32*b* opens at the bottom of a spiral groove 21*g* located at a location which is shifted spirally inward for a predetermined distance from an end of the spiral groove 21*g* of the fixed scroll 21. Note that the opening of this small diameter hole portion 32*b* at the bottom of the spiral groove 21*g* is a circular hole having a larger diameter than a thickness of the wrap 22*b* of the movable scroll 22. The suction capacity regulating mechanism 30 is described in detail below.

The number of turns of the wrap 21*b* is about a half-turn greater than that of the wrap 22*b* of the movable scroll 22 (that is, it constitutes an asymmetrical spiral structure). However, the outmost turn of this wrap 21*b* is not formed with an outer circumferential surface. This portion of the wrap 21*b* without the outer circumferential surface connects with the edge portion 21*c* of the fixed scroll 21. And, the fixed side wrap 21*b* ends in a way such that an end portion of an outer circumferential surface thereof and an end portion of an inner circumferential surface thereof, located at a location where the wrap 21*b* continues for one more turn than the end portion of the outer circumferential side, face each other across the spiral groove 21*g*. An end portion of an outer circumferential surface (the end of the wrap) of the movable side wrap 22*b* is located near the end of the fixed side wrap 21*b*.

The edge portion 21*c* comprises a wall-like portion, which extends downward from an outer circumferential edge portion of the end plate 21*a*, and a flange-like portion, which protrudes radially outward from a lower end part of the wall-like portion and which is fastened to an upper surface of the flange part 23*a* of the housing 23 by a bolt.

Further, in this fixed scroll 21, a suction port 29 is formed near the end of the wrap 21*b*. And, the suction tube 14 is fitted into this suction port 29. Moreover, a check valve (not shown) is disposed in this suction port 29. This check valve allows refrigerant to flow into the compression chamber formed by the fixed scroll 21 and the movable scroll 22 and shuts off a reverse flow of the refrigerant.

c) Movable Scroll

The movable scroll 22 is, as shown in FIG. 1, primarily composed of an end plate 22*a*, a spiral-shaped (an involute-shaped) wrap 22*b* formed on the upper surface of the end plate 22*a*, a bearing portion 22*c* formed on the lower surface of the end plate 22*a*, and a groove portion 22*e* formed in both ends of the end plate 22*a*.

The end plate 22*a* is located in a first concave portion 23*e* disposed on an upper end surface of the housing 23.

The bearing portion 22*c* is located in a second concave portion 23*f* disposed in a main body portion 23*b* of the housing 23.

Figure 2:
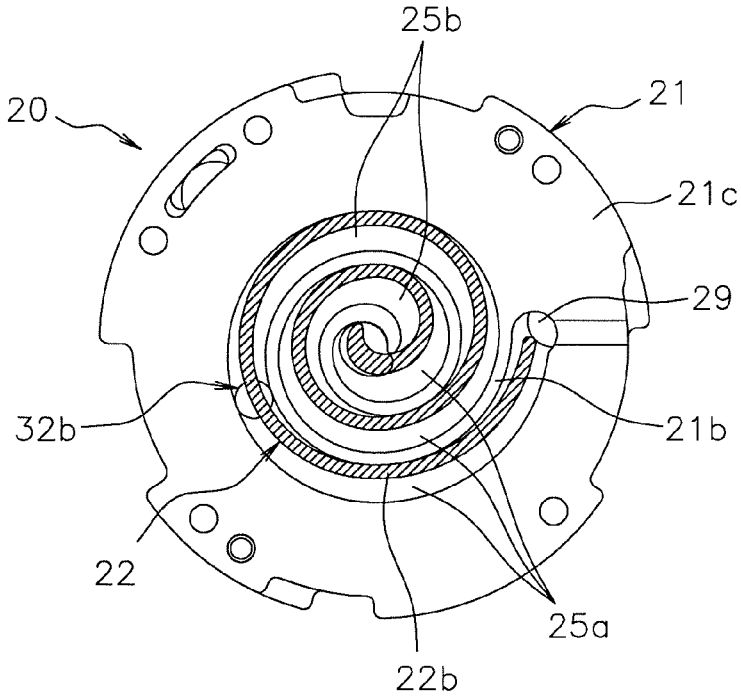
FIG. 2 is a cross-sectional view along the line II-II of FIG. 1.

The wrap 22*b* is meshed with the wrap 21*b* of the fixed scroll 21. As a result, a plurality of compression chambers 25*a*, 25*b* are formed between contact portions of the two wraps 21*b*, 22*b*, as shown in FIG. 2. Note that in this embodiment, for convenience of explanation, the compression chamber 25*a* formed between an inner circumferential surface of the wrap 21*b* of the fixed scroll 21 and an outer circumferential surface of the wrap 22*b* of the movable scroll 22 is referred to as "a first compression chamber", and the compression chamber 25*b* formed between an outer circumferential surface of the wrap 21*b* of the fixed scroll 21 and an inner circumferential surface of the movable side wrap 22*b* is referred to as "a second compression chamber". Furthermore, in the scroll compression mechanism 20, a plurality of the first compression chambers 25*a* and the second compression chambers 25*b* are formed respectively. Further, in this embodiment, the number of turns of the wrap 21*b* is greater than the number of turns of the wrap 22*b* of the movable scroll 22. Thus, a maximum capacity of the first compression chamber 25*a* is larger than a maximum capacity of the second compression chamber 25*b*. And, an eccentric portion 42 of the crank shaft 40 is inserted into the bearing portion 22*c* via a sliding bearing 22*d*. The Oldham ring 24 is fitted into the groove portion 22*e*. Furthermore, the Oldham ring 24 is fitted into the Oldham grooves (not shown) formed in the housing 23, so that the movable scroll 22 is supported to the housing 23 via the Oldham ring 24. And, by means of the movable scroll 22 being incorporated into the scroll compression mechanism 20 in this manner, the movable scroll 22 orbits, without rotating, in the housing 23 around the shaft center of a main shaft portion 41 as the center of its orbit due to the rotation of the crank shaft 40. Furthermore, the orbital radius of the movable scroll 22 is equal to an eccentric amount of the eccentric portion 42, that is, a distance from the shaft center of the main shaft portion 41 to the shaft center of the eccentric portion 42. And, in response to the orbital motion of the movable scroll 22, the volumes of the compression chambers 25*a*, 25*b* decrease as they move spirally inward toward the center of the orbit of the movable scroll 22. A gas refrigerant is, through this volume reduction arrangement, compressed in the high pressure dome-type scroll compressor 1 of this embodiment.

d) Oldham Ring

The Oldham ring 24 is a member for preventing the movable scroll 22 from rotating, as described above, and is fitted into the Oldham grooves (not shown) formed in the housing 23. Furthermore, these Oldham grooves have an elliptical shape and are disposed at positions opposite to each other in the housing 23.

(3) Suction Capacity Regulating Mechanism

Figure 3:
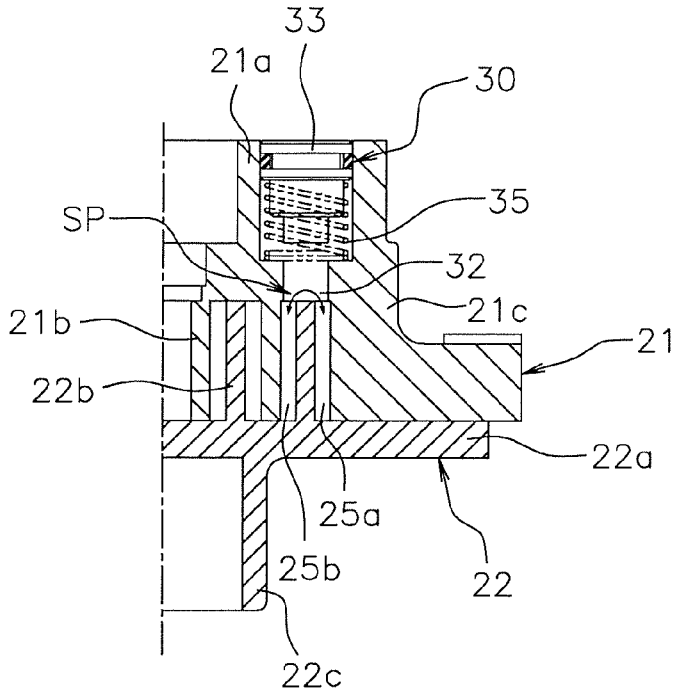
FIG. 3 is a longitudinal sectional view of a suction capacity regulating mechanism.
Figure 4:
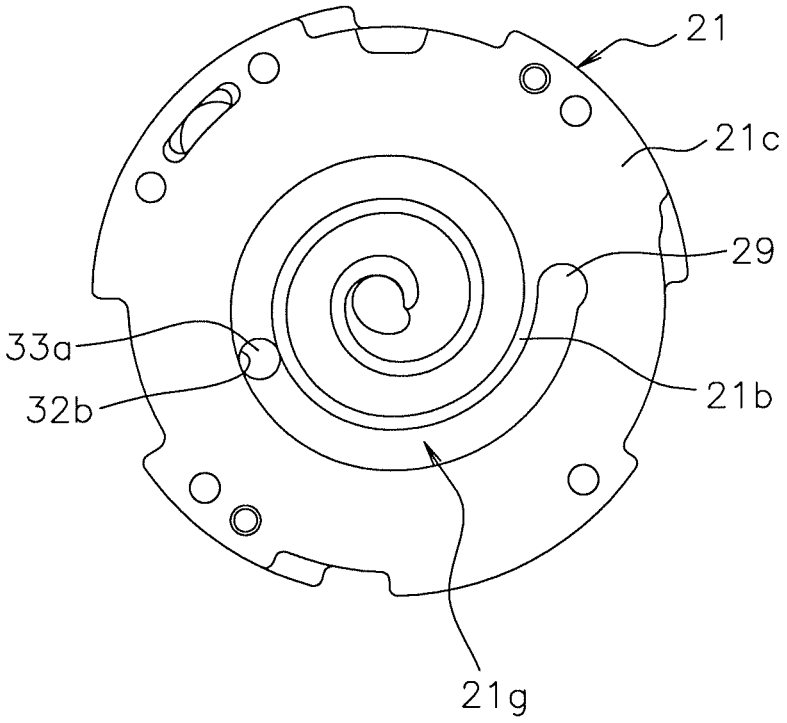
FIG. 4 is a bottom plane view of a fixed scroll.
Figure 5:
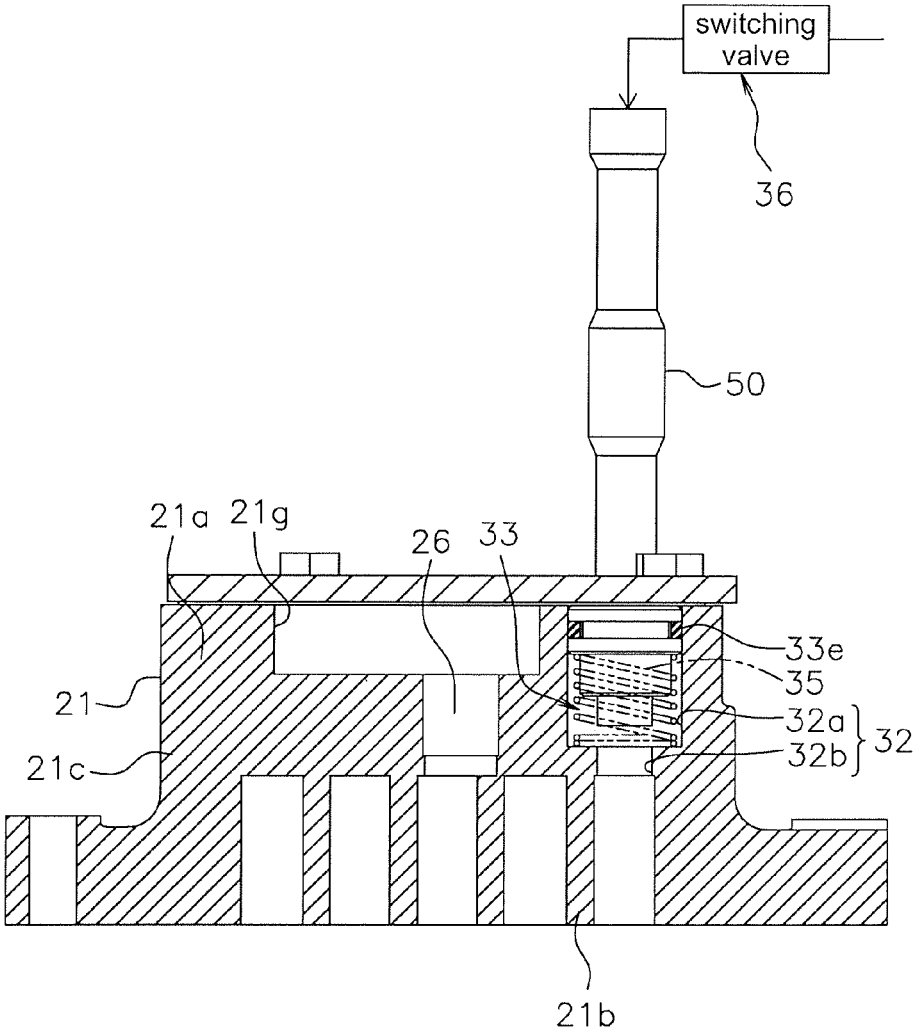
FIG. 5 is a longitudinal sectional view showing a subassembly of the fixed scroll.
Figure 6:
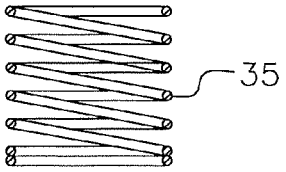
FIG. 6 is a longitudinal sectional view of a compression coil spring for constituting the suction capacity regulating mechanism.

The suction capacity regulating mechanism 30 is a mechanism for regulating the suction capacity by regulating shut-off positions of compression chambers 25*a*, 25*b* for suction in a suction step of the compression mechanism 20 (a position in which the suction step is completed and a compression step starts). As shown in FIG.3, the suction capacity regulating mechanism 30 is primarily composed of a communicating hole 32 formed in the end plate 21*a* of the fixed scroll 21, a gas refrigerant introducing pipe 50 whose inner space connects to the communicating hole 32, a lid body 27 which has an opening for receiving an end portion of the gas refrigerant introducing pipe 50 and supports the gas refrigerant introducing pipe 50 and covers an upper side of the communicating hole 32, a piston 33 inserted in the communicating hole 32, a compression coil spring 35 for biasing the piston 33 toward a side of the gas refrigerant introducing pipe, and a switching valve 36 for switching between "a condition of applying low pressure to the piston 33 through the gas refrigerant introducing pipe 50" and "a condition of applying high pressure to the piston 33 against a biasing force per unit area of the compression coil spring 35 through the gas refrigerant introducing pipe 50" .

Figure 7:
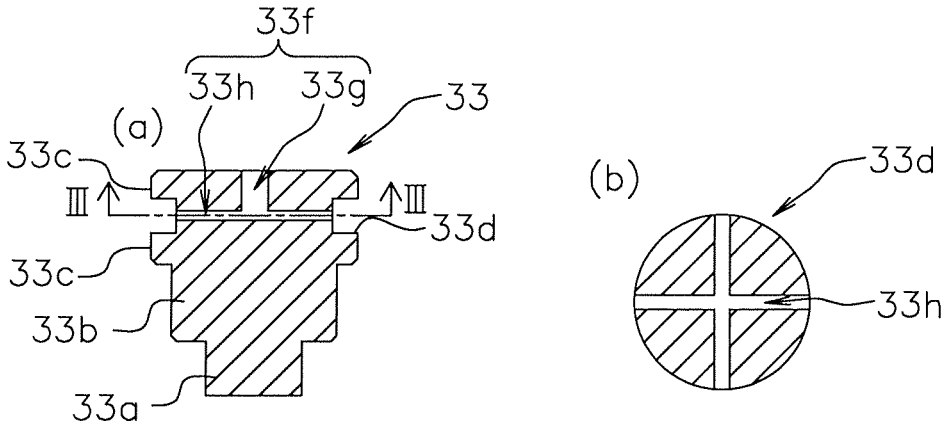
FIG. 7 (*a*) is a longitudinal sectional view of a piston for constituting the suction capacity regulating mechanism, and FIG. 7(*b*) is a cross-sectional view along the line III-III of the piston shown in FIG. 7 (*a*).
Figure 8:
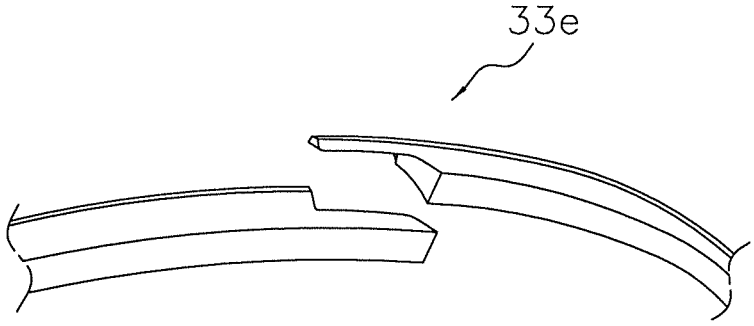
FIG. 8 is an exterior perspective view of a piston ring.

As shown in FIG. 7, the piston 33 is primarily composed of a plug portion 33*a* having a size to fit in the small diameter hole portion 32*b*, a spring receiving portion 33*b* which has a diameter larger than that of the plug portion 33*a* and to which the compression coil spring 35 is attached on an outer circumferential surface, a seal attaching portion 33*c* having a diameter larger than that of the spring receiving portion 33*b*, an annular seal receiving groove 33*d* formed on an outer periphery of the seal attaching portion 33*c*, and a through hole 33*f* which opens at an upper end surface of the seal attaching portion 33*c* and a bottom surface of the seal receiving groove 33*d*. Furthermore, in the seal receiving groove 33*d*, a piston ring 33*e* made of synthetic resin is attached thereto, as shown in FIG. 8. Further, a fitting end of this piston ring 33*e* has a step-like design as shown in FIG. 8, not a single right-angled fitting end. And, this piston 33 is movable between an opening position for opening the communicating hole 32 and a closing position for closing the communicating hole 32, via the compression coil spring 35 and the switching valve 36. Further, the through hole 33*f* is, as shown in FIG. 7, composed of a longitudinal hole 33*g* formed along a center shaft of the piston 33 and four lateral holes 33*h*, each of which extends radially from a lower end of the longitudinal hole to an outer circumferential surface of the piston 33.

Figure 9:
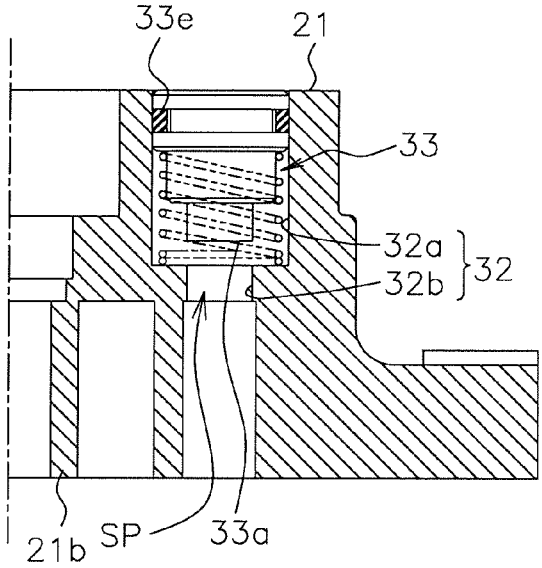
FIG. 9 is a longitudinal sectional view showing a condition of the piston under a regulating operation.
Figure 10:
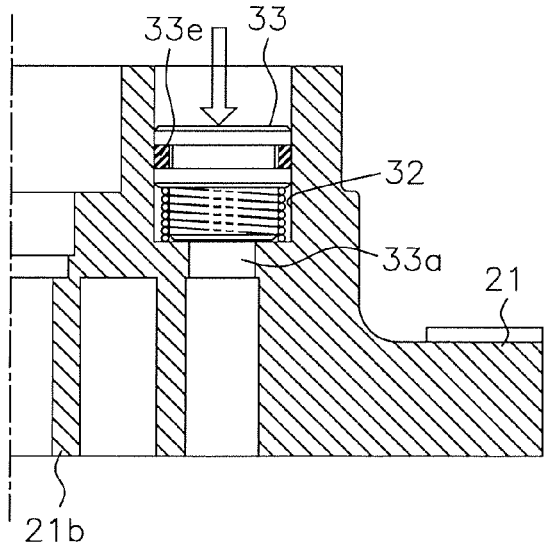
FIG. 10 is a longitudinal sectional view showing a condition of the piston under a normal operation.

This suction capacity regulating mechanism 30 is able to switch between conditions of "communicate" and "shut-off" for the first compression chamber 25*a* and the second compression chamber 25*b* by means of the above-described configuration. Specifically, when a low pressure is applied to a rear end surface (upper end surface) of the piston 33 by the switching valve 36, a force exerted by the compression coil spring 35 to push up the piston 33 exceeds a force pushing down the piston 33. Accordingly, as shown in FIG. 3 and FIG. 9, the above-described communicating hole 32 opens. As a result, a gap space SP is formed at a lower portion of the piston 33, so that the first compression chamber 25*a* and the second compression chamber 25*b* are in the "communicate" condition (refer to FIG. 3). On the other hand, when a high pressure is applied to a rear end surface of the piston 33 by the switching valve 36, a force exerted by the compression coil spring 35 to push down the piston 33 exceeds a force by the compression coil spring 35 to push up the piston 33. Accordingly, as shown in FIG. 10, the communicating hole 32 is shut, so that the first compression chamber 25*a* and the second compression chamber 25*b* are in the "shut-off" condition. Furthermore, in the "shut-off" condition, a refrigerant is compressed to a predetermined extent in a suction capacity. Note that hereinbelow, an operation under this condition is referred to as "a normal operation". Moreover, in the "communicate" condition, the refrigerant is compressed in the suction capacity to an extent less than the predetermined extent. Note that hereinbelow, an operation under this condition is referred to as "a regulating operation". Furthermore, in this embodiment, when the regulating operation is carried out, a rotation speed of the drive motor 45 is faster than a rotation speed of the drive motor 45 under the normal operation.

(4) Drive Motor

The drive motor 45 is a brushless DC motor capable of regulating a rotation speed variably by inverter control in this embodiment, and is primarily composed of an annular stator 46 secured to the inner wall surface of the casing 10, and a rotor 47 rotatably accommodated with a small gap (air gap channel) inside the stator 46. The drive motor 45 is disposed so that the upper end of a coil end 46*a* formed at the top side of the stator 46 is at substantially the same height as the lower end of the bearing portion 23*c* of the housing 23.

A copper wire is wound around a tooth portion of the stator 46, and coil ends 46*a* are formed above and below the stator 46.

The rotor 47 is connected to the movable scroll 22 of the scroll compression mechanism 20 via the crank shaft 40 disposed in the axial center of the trunk shell 11 so as to extend vertically. The crank shaft 40 is rotated in response to the rotation of this rotor 47.

(5) Crank Shaft

The crank shaft 40 is disposed in the axial center of the trunk shell 11 so as to extend vertically. This crank shaft 40 is primarily composed of a main shaft portion 41 and an eccentric portion 42. The eccentric portion 42 is formed so as to have a smaller diameter than that of the main shaft portion 41 and is formed on an upper end surface of the main shaft portion 41. And, this eccentric portion 42 is eccentric with respect to a shaft center of the main shaft portion 41 by a predetermined amount.

Furthermore, within the crank shaft 40, an oil feed passage which extends vertically is formed. Further, in a lower end of the main shaft portion 41, an oil feed pump 43 is disposed. Through this oil feed pump 43, refrigerator oil is drawn up from a bottom portion of the casing 10. The refrigerator oil is supplied to sliding portions of the compression mechanism 20 and bearing portions for the crank shaft 40 through the oil feed passage of the crank shaft 40.

(6) Lower Main Bearing

The lower main bearing 48 is disposed in a lower space below the drive motor 45. The lower main bearing 48 is secured to the trunk shell 11 of the casing 10, and supports the lower end of the main shaft portion 41 of the crank shaft 40 rotatably via a sliding bearing 48*a*.

(7) Suction Tube

The suction tube 14 is used for guiding the refrigerant of the refrigerant circuit to the scroll compression mechanism 15 and is provided in the fixed scroll 21 with an opening penetrating through the lid portion 12 of the casing 10.

(8) Discharge Tube

The discharge tube 15 is used for discharging the refrigerant inside the casing 10 to the outside of the casing 10, and is provided in the trunk shell 11 of the casing 10 with an opening penetrating through the trunk shell 11. An end portion of the discharge tube 15 is disposed so as to be located between the compression mechanism 20 and the drive motor 45 in the casing 10.

<Operation of High Pressure Dome-Type Scroll Compressor>

When the drive motor 45 is driven, the crank shaft 40 rotates and the movable scroll 22 orbits with respect to the fixed scroll 21. At this time, the movable scroll 22 is prevented from rotating by the Oldham ring 24. Along with the orbital motion of the movable scroll 22, volumes of the compression chambers 25*a*, 25*b* increase and decrease repeatedly and periodically. The refrigerant in the refrigerant circuit is drawn from the suction tube 14 to the compression chambers 25*a*, 25*b* through the suction port 29 when the volume of a portion connected to the suction port 29 increases, and the refrigerant is compressed when the volume of a portion whose suction side is shut off decreases. Furthermore, along with the orbital motion of the movable scroll 22, each of the first compression chambers 25*a* and the second compression chambers 25*b* connects to the suction port 29 intermittently. At the same time, each of the first compression chambers 25*a* and the second compression chambers 25*b* connects to the discharge passage 26 intermittently. The compressed refrigerant is discharged to the discharge space 28 through the discharge passage 26. The refrigerant discharged to the discharge space 28, then, flows into the high-pressure space 16 in a lower portion of the housing 23 through a gas passage which is not shown, and is supplied to the condenser of the refrigerant circuit from the discharge tube 15.

(1) Operation of the Compression Mechanism Under Normal Operation

Here, refrigerant suction operation and refrigerant compression operation of the compression mechanism 20 under normal operation are explained with reference to FIG. 11 to FIG. 16. Under the normal operation, the piston 33 is located in a closing position, and the communicating hole 32 is shut. Therefore, the first compression chambers 25*a* and the second compression chambers 25*b* are in the "shut-off" condition. Note that in FIG. 11 to FIG. 16, operation conditions of the compression mechanism 20 are shown in six separate steps. Furthermore, these figures represent a case in which the movable scroll 22 is orbiting clockwise with a predetermined angular gap.

Figure 11:
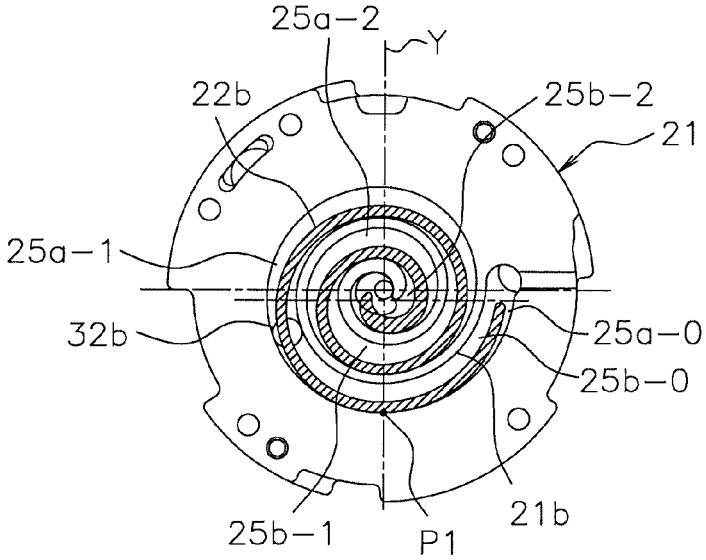
FIG. 11 is a transverse sectional view showing a condition in a first step of a compressing mechanism.

Firstly, in the first step (as shown in FIG. 11), the end of the wrap 22*b* of the movable scroll 22 is located between two turns of the wrap 21*b* of the fixed scroll 21. Both of the outermost first compression chamber 25*a*-0 and the outermost second compression chamber 25*b*-0 connect with the suction port 29 to be open to a low-pressure side. Furthermore, at a point P1 on a center line Y in the figure, an outer circumferential surface of the movable side wrap 22*b* and an inner circumferential surface of the fixed side wrap 21*b* are substantially in contact with each other (note that "contact" used here means a condition in which a leak of the refrigerant does not matter because of an oil film formed in spite that a micron-order gap exists.). A first compression chamber 25*a*-1 located more spirally inward (the end of a scroll) than the contact position (seal point) P1 has already been in a compression step.

Figure 12:
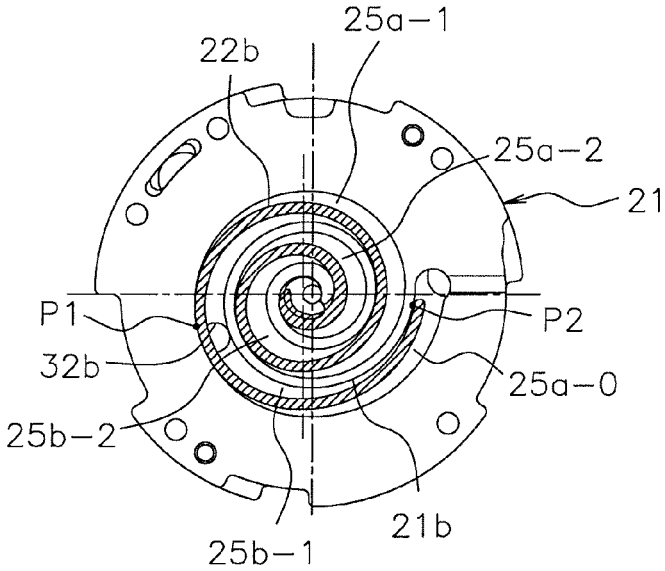
FIG. 12 is a transverse sectional view showing a condition in a second step of the compressing mechanism.

When the movable scroll 22 further orbits clockwise from the first step to enter the second step (as shown in FIG. 12), an inner circumferential surface of an end of the wrap 22*b* of the movable scroll 22 is in contact with an outer circumferential surface of the wrap 21*b* of the fixed scroll 21. The contact point (seal point) P2 is the suction shut-off position of the second compression chamber 25*b*-1. At this time, the outermost first compression chamber 25*a*-0 is in the middle of a suction step in which a capacity thereof increases. A seal point at the end of this first compression chamber 25*a*-0 is not formed yet.

Figure 13:
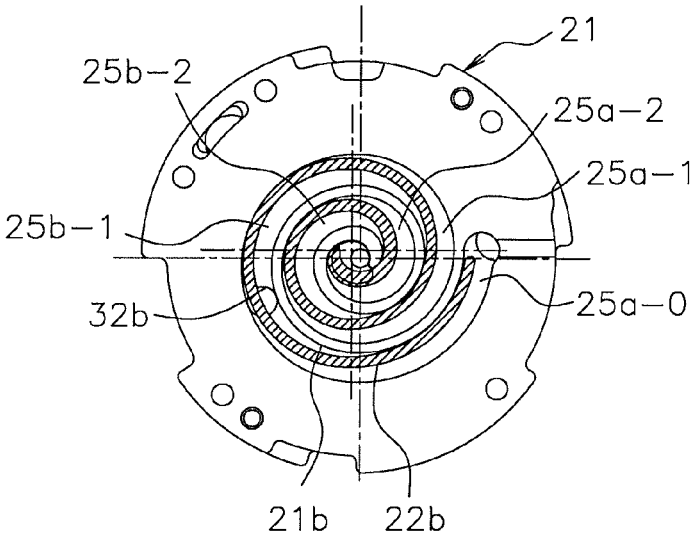
FIG. 13 is a transverse sectional view showing a condition in a third step of the compressing mechanism.

When the movable scroll 22 further orbits clockwise from the second step to enter the third step (as shown in FIG. 13), the capacity of the second compression chamber 25*b*-1 decreases and compression step of refrigerant in this second compression chamber 25*b*-1 starts. The capacity of the outermost first compression chamber 25*a*-0 further increases and the suction step continues.

Figure 14:
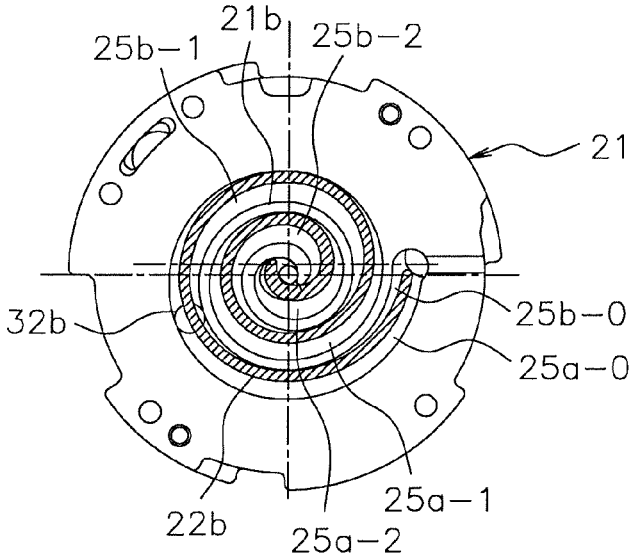
FIG. 14 is a transverse sectional view showing a condition in a fourth step of the compressing mechanism.

When the movable scroll 22 further orbits clockwise from the third step to enter the fourth step (as shown in FIG. 14), the compression step of the second compression chamber 25*b*-1 and the suction step of the outermost first compression chamber 25*a*-0 further continue. Furthermore, at this time, a new second compression chamber 25*b*-0 is formed at an end of the wrap more spirally outward than the second compression chamber 25*b*-1, which is already in the middle of compression, and a suction step starts in the new second compression chamber.

Figure 15:
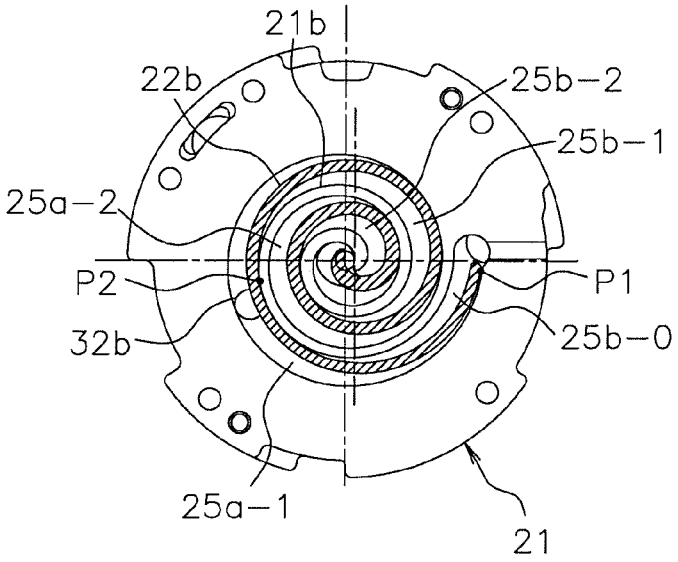
FIG. 15 is a transverse sectional view showing a condition in a fifth step of the compressing mechanism.

When the movable scroll 22 further orbits clockwise from the fourth step to enter the fifth step (as shown in FIG. 15), the suction step of the outermost second compression chamber 25*b*-0 continues and, on the other hand, the outer circumferential surface of the end of the wrap 22*b* of the movable scroll 22 is in contact with the inner circumferential surface of the wrap 21*b* of the fixed scroll 21. The contact point (seal point) P1 is the suction shut-off position of the first compression chamber 25*b*-1.

Figure 16:
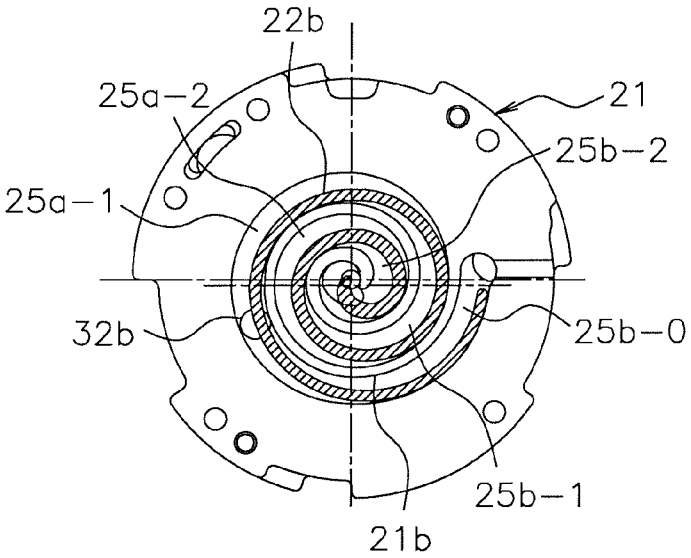
FIG. 16 is a transverse sectional view showing a condition in a sixth step of the compressing mechanism.

When the movable scroll 22 further orbits clockwise from the fifth step to enter the sixth step (as shown in FIG. 16), a compression step of the first compression chamber 25*a*-1 formed in the fifth step proceeds, and the suction step of the outermost second compression chamber 25*b*-0 continues. And, when the movable scroll 22 further orbits clockwise, the step returns to the first step. A new first compression chamber 25*a*-0 is formed more spirally outward (the end of a scroll) than the first compression chamber 25*a*-1, which is in the middle of compression. And, when the first compression chamber 25*a*-2 and the second compression chamber 25*b*-2 move to the innermost part of the spiral and their respective capacities reach a minimum, they are in contact with the discharge port 26. Thereafter, the refrigerant fully compressed in these two compression chambers 25*a*-2, 25*b*-2 is discharged from the compression mechanism 20.

(2) Operation of the Compression Mechanism Under Regulating Operation

Here, refrigerant suction operation and refrigerant compression operation of the compression mechanism 20 under regulating operation are explained with reference to FIG. 11 to FIG. 16 in the same way as above. Under the regulating operation, the piston 33 is in an opening position, and the small diameter portion 32*b* of the communicating hole 32 is open. Therefore, the first compression chambers 25*a* and the second compression chambers 25*b* are in the "communicate" condition.

Firstly, in the first step (as shown in FIG. 11), as is under the normal operation, the end of the wrap 22*b* of the movable scroll 22 is located between two turns of the wrap 21*b* of the fixed scroll 21. Both of the outermost first compression chamber 25*a*-0 and the outermost second compression chamber 25*b*-0 connect with the suction port 29 to be open to a low-pressure side. However, under the regulating operation, this first compression chamber 25*a*-1 is connected with the outermost second compression chamber 25*b*-0 which is in the middle of the suction step via the communicating hole 32. Therefore, the first compression chamber 25*a*-1 is still in a condition before the suction shut-off position is reached, and is in the middle of the same suction step as the second compression chamber 25*b*-0.

When the movable scroll 22 orbits clockwise from the first step to enter the second step (as shown in FIG. 12), the contact point P1 between the inner circumferential surface of the wrap 21*b* of the fixed scroll 21 and the outer circumferential surface of the wrap 22*b* of the movable scroll 22 is shifted to a position just after passing through the communicating hole 32. Therefore, the contact point (seal point) P1 at this time is the suction shut-off position of the first compression chamber 25*a*-1. On the other hand, under this condition, the outermost second compression chamber 25*b*-1 to be shut off under the normal operation connects with the outermost first compression chamber 25*a*-0 formed at a scroll outer circumferential side of the first compression chamber 25*a*-1 turned to the compression step via the communicating hole 32. And, as this outermost first compression chamber 25*a*-0 is in the middle of the suction step, the second compression chamber 25*b*-1 is in a condition before the suction shut-off Furthermore, this condition is similar to that in the third step (as shown in FIG. 13) and the fourth step (as shown in FIG. 14). In the third step, the second compression chamber 25*b*-1 is in a condition before the suction shut-off A seal point at the end of the wrap is not formed yet. Further, at this time, the outermost first compression chamber 25*a*-0 is also in the middle of the suction step. Furthermore, in the fourth step, a new second compression chamber 25*b*-0 starts being formed at the end of the scroll more spirally outward than the second compression chamber 25*b*-1.

When the movable scroll 22 further orbits clockwise from the fourth step to enter the fifth step (as shown in FIG. 15), the contact point P2 between the outer circumferential surface of the wrap 21*b* of the fixed scroll 21 and the inner circumferential surface of the wrap 22*b* of the movable scroll 22 passes through the communicating hole 32. Therefore, the contact point P2 at this time is the seal point of the second compression chamber 25*b*-1. The compression step of the second compression chamber 25*b*-1 starts. Note that under the normal operation, in this step, the outermost first compression chamber 25*a*-1 is in a condition of shut-off. However, under the regulating operation, the outermost first compression chamber 25*a*-1 connects with the low-pressure side via the outermost second compression chamber 25*b*-0. Thus, the first compression chamber 25*a*-1 is still in the middle of the suction step. Furthermore, this condition is similar to that in the sixth step (as shown in FIG. 16) and the first step (as shown in FIG. 11).

As such, when the communicating hole 32 is open, both suction capacities of the first compression chambers 25*a* and the second compression chambers 25*b* are smaller in comparison with them under the normal operation. As a result, under the regulating operation, the amount of gas in circulation is less than that under the normal operation, thereby resulting in a low-power operation. Furthermore, in this embodiment, when the regulating operation is carried out, the rotation speed of the drive motor 45 is set so as to be faster than that under the normal operation. Thus, a power under the regulating operation can be maintained so as to be equal to the power under the normal operation.

<Characteristics of the High Pressure Dome-Type Scroll Compressor According to the First Embodiment>

In the high pressure dome-type scroll compressor 1 according to this embodiment, the seal receiving groove 33*d* and the through hole 33*f* are formed on the piston 33 in the suction capacity regulating mechanism 30. Further, the piston ring 33*e* having a step-like fitting end is fitted into the seal receiving groove 33*d*. Therefore, in this scroll compressor 1, when a gas refrigerant that applies a pressure larger than biasing force of the compression coil spring 35 for biasing the piston 33 per unit area is introduced into the gas refrigerant introducing pipe 50, the high-pressure gas refrigerant passes through the through hole 33*f* of the piston 33 and pushes the piston ring 33*e* against a wall of the through hole 33*f*. Then, the piston ring expands slightly at this time. Since the fitting end has a step-like structure, it is able to suppress a leak of the high-pressure fluid effectively. Further, at the beginning of introducing the high-pressure gas refrigerant, the high-pressure gas refrigerant flows through a minute gap between the piston 33 and the communicating hole 32 of the fixed scroll 21.

Thus, the piston ring 33*e* is pushed against a side of the compression chamber. Therefore, in this scroll compressor 1, when the high-pressure gas refrigerant that applies a pressure larger than biasing force of the compression coil spring 35 per unit area is introduced into the gas refrigerant introducing pipe 50, it is able to effectively suppress the high-pressure fluid flowing into compression chambers 25*a*, 25*b*. Therefore, in this scroll compressor 1, it is able to suppress a power reduction in the normal operation.

<Variation of the First Embodiment>

(A)

Figure 17:
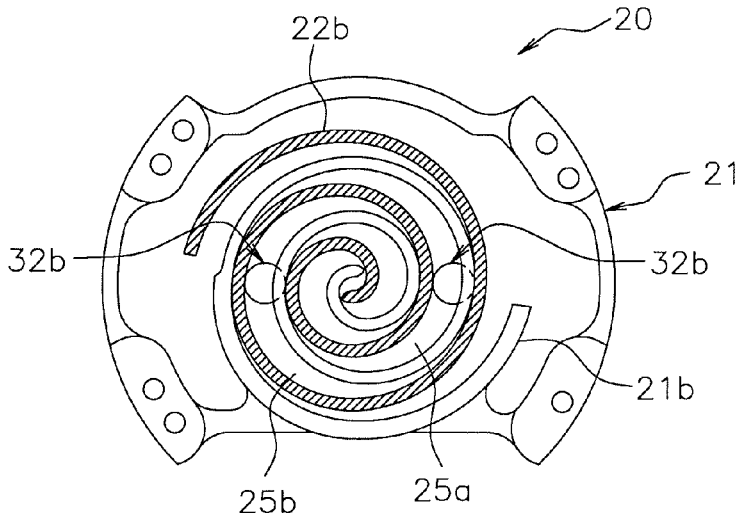
FIG. 17 is a transverse sectional view of a compressing mechanism according to a variation of the first embodiment.
Figure 18:
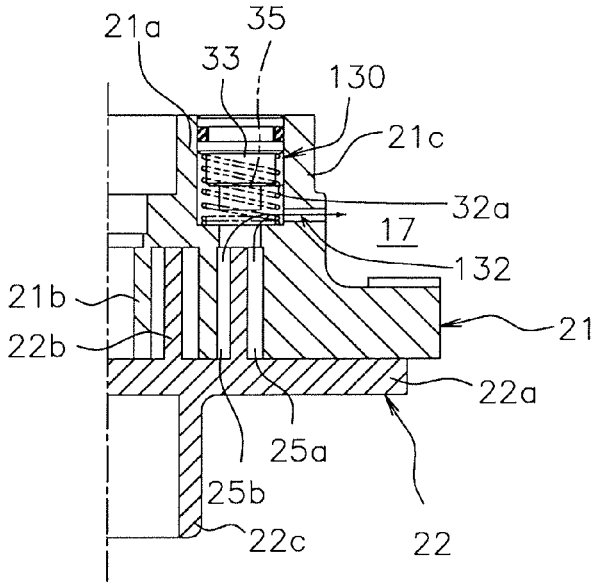
FIG. 18 is a longitudinal sectional view of a suction capacity regulating mechanism according to the second embodiment.

In the high pressure dome-type scroll compressor 1 according to the first embodiment, the number of turns of the wrap 21*b* of the fixed scroll 21 is about a half-turn greater than that of the wrap 22*b* of the movable scroll 22. However, as shown in FIG. 17, the number of turns of the wrap 21*b* of the fixed scroll 21 may be equal to the number of turns of the wrap 22*b* of the movable scroll 22. Furthermore, in this case, the operation is identical to examples of FIG. 11 to FIG. 16.

(B)

In the high pressure dome-type scroll compressor 1 according to the first embodiment, the opening of the small diameter hole portion 32*b* of the communicating hole 32 is disposed at only one portion within one turn of the outer circumferential side of the scroll groove of the fixed scroll 21. However, openings of the communicating hole 32 may be disposed at plural locations. Further, in this case, plural communicating holes corresponding to the openings may be formed. By doing so, the scroll compressor is able to regulate the suction capacity of the compression mechanism 20 in a step-by-step manner. Therefore, it is possible to carry out finer control according to an operation condition of the refrigerant circuit.

(C)

In the first embodiment, the scroll compressor having the scroll compression mechanism 20 which combines the fixed scroll 21 with the movable scroll 22, is explained as one example. However, the present invention is applicable to a double-gear type scroll compressor or a scroll compressor in which both scroll members orbit.

(D)

In the high pressure dome-type scroll compressor 1 according to the first embodiment, the communicating hole 32 formed in the fixed scroll 21 is composed of the large diameter hole portion 32*a* and the small diameter hole portion 32*b*. However, a communicating hole is not limited to such a design and may be formed in any appropriate shape.

The Second Embodiment

A high pressure dome-type scroll compressor 1 according to the second embodiment is the same as the high pressure dome-type scroll compressor 1 according to the first embodiment except for its suction capacity regulating mechanism. Therefore, hereinafter, only the suction capacity regulating mechanism is explained.

In a suction capacity regulating mechanism 130 according to the second embodiment, in addition to the constituent elements of the suction capacity regulating mechanism 30 according to the first embodiment, a leak hole 132 which causes the low-pressure space 17 to connect to the small diameter hole portion 32*b* is disposed. In this embodiment, with such structure of the suction capacity regulating mechanism 130, under the regulating operation, the first compression chamber 25*a* and the second compression chamber 25*b* connect to each other and also, the first compression chamber 25*a* and the second compression chamber 25*b* connect to the low-pressure space 17. Furthermore, under the normal operation, the first compression chamber 25*a* and the second compression chamber 25*b* are shut-off from each other and also, the first compression chamber 25*a* and the second compression chamber 25*b* are shut-off from the low-pressure space 17.

<Variation of the Second Embodiment>

(A)

In the high pressure dome-type scroll compressor 1 according to the second embodiment, the low-pressure space 17 and the small diameter hole portion 32*b* connect to each other through the leak hole 132. However, a leak hole may be formed so that a pipe of a suction side of the compression mechanism 20 and the small diameter hole portion 32*b* connect to each other. And further, if a suction space is provided, the leak hole may be formed so that the suction space and the small diameter hole portion 32*b* connect to each other.

(B)

In the high pressure dome-type scroll compressor 1 according to the second embodiment, the communicating hole 32 and the leak hole 132 are formed so that, under the regulating operation, the first compression chamber 25*a* and the second compression chamber 25*b* connect to each other and also, the first compression chamber 25*a* and the second compression chamber 25*b* both connect to the low-pressure space 17. However, the communicating hole 32 and the leak hole 132 may be formed so that, under the regulating operation, only either the first compression chamber 25*a* or the second compression chamber 25*b* connects to the low-pressure space 17.

The Third Embodiment

The high pressure dome-type scroll compressor 1 according to the third embodiment is the same as the high pressure dome-type scroll compressor 1 according to the first embodiment except for its communicating hole. Therefore, hereinafter, only the communicating hole is explained.

Figure 19:
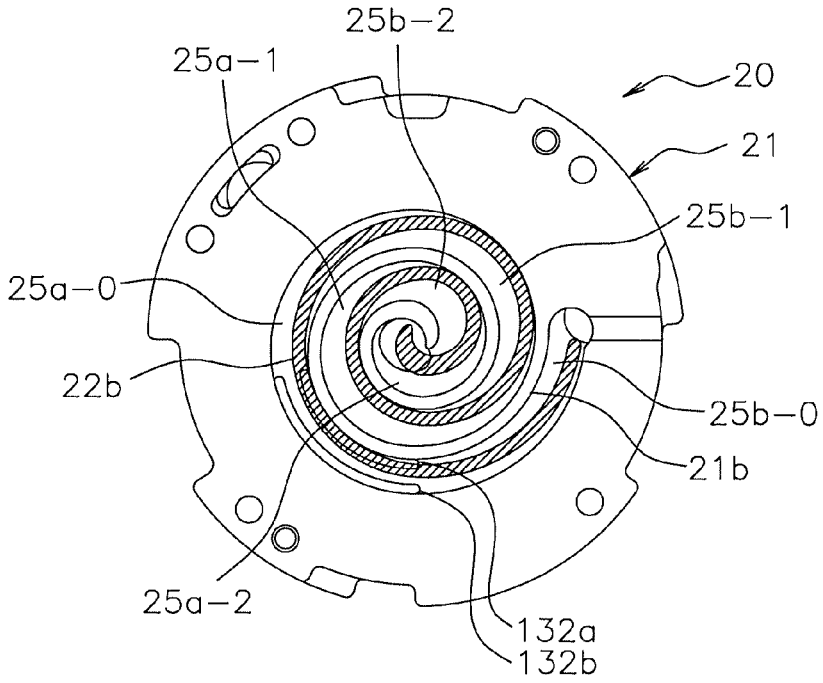
FIG. 19 is a transverse sectional view showing a condition in a first step of a compressing mechanism according to the third embodiment.

Two communicating holes 132*a* and 132*b* according to the third embodiment are formed as shown in FIG. 19. One of the communicating holes is formed for the first compression chamber 25*a*, and the other is formed for the second compression chamber 25*b*. Furthermore, here, the communicating hole referenced by a symbol 132*a* (hereinafter, referred to as "a first communicating hole") is for the first compression chamber 25*a*, and the communicating hole referenced by a symbol 132*b* (hereinafter, referred to as "a second communicating hole") is for the second compression chamber 25*b*. Further, in this embodiment, these communicating holes 132*a*, 132*b* are holes independent from each other. Further, openings of these communicating holes 132*a*, 132*b* have a circular arc shape as shown in FIG. 19. The opening of the first communicating hole 132*a* extends along an inner circumferential surface of the wrap 21*b* of the fixed scroll 21. The opening of the second communicating hole 132*b* extends along an outer circumferential surface of the wrap 21*b* of the fixed scroll 21.

In this case, a suction capacity regulating mechanism is preferably similar to the suction capacity regulating mechanism 30 according to the first embodiment. However, a shape of the piston 33 needs to correspond to each communicating hole 132*a*, 132*b*.

In this embodiment, under the normal operation, as similar to the first embodiment and the second embodiment, a point at which the wraps 21*b* and 22*b* that had been apart from each other at an end side of the scroll are essentially in contact with each other and thereby forming a seal point, becomes the suction shut-off point. At the point, the first compression chamber 25*a* and the second compression chamber 25*b* are formed.

Figure 20:
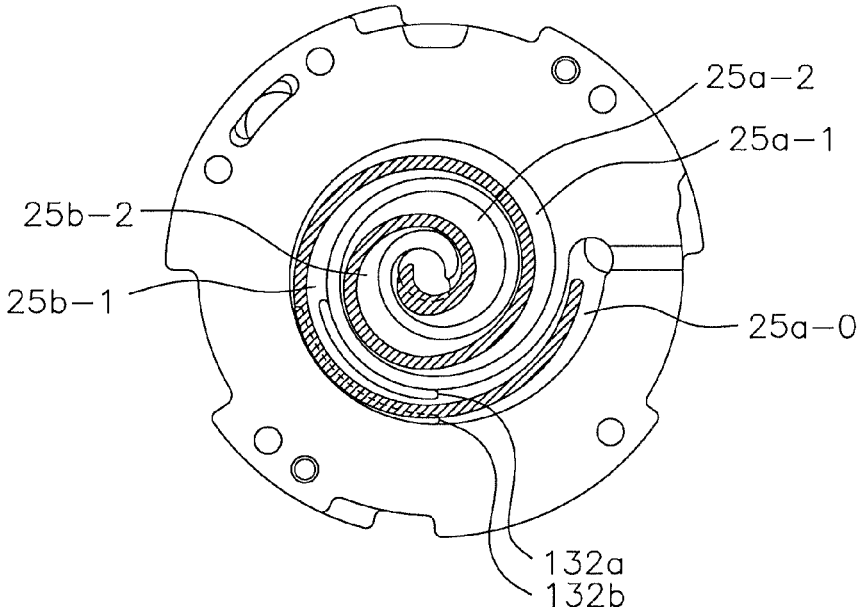
FIG. 20 is a transverse sectional view showing a condition in a second step of the compressing mechanism according to the third embodiment.

On the other hand, under the regulating operation, both of the compression chambers 25*a*, 25*b* are not shut-off until a contact point of wraps 21*b* and 22*b* passes through a position at which openings of the communicating holes 132*a*, 132*b* are located. That is, one of the first compression chamber 25*a* and the second compression chamber 25*b* is in a condition in which a portion of an inner circumferential side of the contact point connects with the suction side of the compression mechanism 20 via a portion of an outer circumferential side thereof, until the contact position passes through openings of the communicating holes 132*a*, 132*b*. A position just after the contact point passes through the openings of the communicating holes 132*a*, 132*b* is the suction shut-off point. As explained further specifically with FIG. 19 and FIG. 20, in a step shown in FIG. 19, the second compression chamber 25*b*-1 which would be shut-off under the normal operation, is not shut-off under the regulating operation. Further, in a step shown in FIG. 20, similar to the step shown in FIG. 19, the first compression chamber 25*a*-1 which would be shut-off under the normal operation, is not shut-off under the regulating operation.

Therefore, the size of a suction capacity can be regulated even in a scroll compressor according to this embodiment.

<Variation of Third Embodiment>

(A)

In the scroll compressor according to the third embodiment, the first communicating hole 132*a* for the first compression chamber 25*a* and the second communicating hole 132*b* for the second compression chamber 25*b* are disposed in the end plate of the fixed scroll. However, only the first communicating hole 132*a* for the first compression chamber 25*a* may be formed so as to decrease a suction capacity of only the first compression chamber 25*a*. By doing so, the difference of gas pressure between the first compression chamber 25*a* and the second compression chamber 25*b* can be decreased. Therefore, it is possible to reduce the effects of vibration due to imbalanced gas load or variation of a rotation torque of the scroll.

(B)

While not referred to specifically in the third embodiment, balance of gas load has a relative relationship between the first compression chamber 25*a* and the second compression chamber 25*b*. Therefore, a regulating position of a suction capacity of the second compression chamber 25*b* may be shifted to a more spirally outward side (an end side) of a scroll than the regulating position of the suction capacity of the first compression chamber 25*a* so as to be able to regulate both of suction capacities of the first compression chamber 25*a* and the second compression chamber 25*b*.

INDUSTRIAL APPLICABILITY

The scroll compressor according to the present invention has a characteristic that even if a fluid that applies a pressure larger than the biasing force of the biasing member per unit area is introduced into the fluid introducing pipe, it is able to effectively suppress the leak of high-pressure fluid into a compression chamber formed by the first scroll member and the second scroll member, and is available for a scroll compressor, especially for those scroll compressors that require a renewal.

What is claimed is:

1. A scroll compressor comprising:

a first scroll member having a first flat plate part, a first spiral wall part having a spiral shape and extending substantially perpendicularly from a first plate surface of the first flat plate part, a fluid inlet formed near an end of the first spiral wall part, a first through hole formed in the first flat plate part and extending from a first opening formed in the first plate surface, the first through hole being located at a position spaced a predetermined length from the fluid inlet, and a third through hole configured to connect to the first through hole, the first through hole being sandwiched between a most outer wall of the first spiral wall part and an inner circumferential wall arranged to be opposite to the most outer wall;

a second scroll member having a second flat plate part, and a second spiral wall part having a spiral shape and extending substantially perpendicularly from a second plate surface of the second flat plate part, the second spiral wall part being configured to mesh with the first spiral wall part;

a casing configured to house the first scroll member and the second scroll member;

a fluid introducing pipe extending through the casing from an opening of the first through hole, the opening being formed at a side of the first through hole opposite to the first opening of the first through hole, and the fluid introducing pipe having an inner space configured to connect to the first through hole;

a piston disposed in the first through hole that is configured to be biased toward the fluid introducing pipe by a biasing force of a biasing member, the piston having an annular groove formed on a side surface of the piston, and a second through hole opening on an end surface of the piston toward the fluid introducing pipe and opening at a bottom surface of the annular groove, the piston having the annular groove and the second through hole being configured such that the piston shuts the first opening while the third through hole connects to the first through hole when a fluid that applies a pressure per unit area larger than the biasing force of the biasing member per unit area is introduced into the fluid introducing pipe and the piston is spaced from the first opening while the third through hole connects to the first opening when a fluid that applies a pressure per unit area smaller than the biasing force of the biasing member per unit area is introduced into the fluid introducing pipe; and a piston ring fitted into the annular groove of the piston and having a stepped fitting end.

* * * * *